US006104917A

United States Patent [19]

Ketonen

[11] Patent Number: 6,104,917

[45] Date of Patent: Aug. 15, 2000

[54] APPARATUS, AND ASSOCIATED METHOD, FOR MAINTAINING CIRCUITRY OF RADIO DEVICE ABOVE A THRESHOLD TEMPERATURE

[75] Inventor: Veli-Pekka Ketonen, Irving, Tex.

[73] Assignee: Nokia Networks Oy, Espo, Finland

[21] Appl. No.: 09/259,847

[22] Filed: Mar. 1, 1999

[51] Int. Cl.[7] ..... H01Q 11/12

[52] U.S. Cl. ..... 455/117; 455/115; 455/67.1; 455/561; 330/307 P; 330/289

[58] Field of Search ..... 455/117, 115, 455/127, 126, 67.1, 561; 330/207 P, 289

[56] References Cited

U.S. PATENT DOCUMENTS 4,939,786 7/1990 McCallum et al. ..... 455/67.1

5,920,808 7/1999 Jones et al. ..... 455/127

*Primary Examiner*—Lee Nguyen

*Attorney, Agent, or Firm*—Robert H. Kelly; Holland & Hart LLP

[57] ABSTRACT

Apparatus, and an associated method, facilitates maintenance of ambient temperature levels within a radio base station cabinet above a minimum temperature level. During periods of low activity at a radio base station, signals are applied to a power amplifier of the transmitter portion of the radio base station. Thermal energy is generated as a byproduct of amplification of the signals provided thereto. The signals are selected such that the signals are rejected by filter circuitry, such as the duplexer filter circuitry, of the radio base station. Thereby, thermal energy is generated but amplified signals are prevented from being transmitted by the radio base station.

20 Claims, 4 Drawing Sheets

APPARATUS, AND ASSOCIATED METHOD, FOR MAINTAINING CIRCUITRY OF RADIO DEVICE ABOVE A THRESHOLD TEMPERATURE

The present invention relates generally to a manner by which to overcome temperature effects upon radio circuitry, such as the transceiver circuitry of a radio base station of a cellular communication system. More particularly, the present invention relates to apparatus, and an associated method, by which to generate thermal energy through operation of the existing circuitry of the radio device to maintain the temperature about the radio device at least as high as a selected temperature level. Operation of an embodiment of the present invention obviates the need for separate heating elements, conventionally utilized to maintain the temperature levels of the radio device.

BACKGROUND OF THE INVENTION

Electrical components, and electrical devices which include such components, exhibit electrical characteristics which are, to varying extents, temperature dependent. That is to say, such temperature dependency causes the components, and the electrical devices which include such components, to perform in manners dependent upon the ambient temperature levels about such components or devices.

For instance, impedance values of many electrical components, such as resistive elements, are directly related to the temperature levels of such components. A circuit including such resistive elements, constructed to be operable in a certain manner at a particular temperature might, at other temperature levels, exhibit altered operation. Analogously, transistor elements are also of characteristics which are temperature dependent. A circuit including such transistor elements might also exhibit altered operation at different temperature levels.

If the change in electrical characteristics is significant, operation of an electrical device including such components might be affected significantly as a result of temperature fluctuations. One manner by which to reduce the effects of temperature fluctuations upon the operation of an electrical device is to select the components thereof to be of constructions which exhibit reduced levels of variance as a result of changes in temperature. However, electrical components which exhibit reduced levels of variance due to temperature fluctuations are sometimes more expensive than their counterparts which exhibit greater levels of variance. And, in some instances, electrical components which exhibit characteristics which are relatively temperature invariant are simply not available.

Another manner by which to reduce the effects of temperature on the operation of an electrical device including such components is to maintain the electrical device in a temperature-controlled environment. By maintaining the electrical device in the controlled environment, changes in temperature of the electrical components do not occur, and the variance in operation of the electrical device is avoided.

A radio device is exemplary of a device which includes electrical components which exhibit characteristics which are temperature-dependent. For instance, a radio transmitter operable to transmit radio signals is a device whose operation is affected by the ambient temperature levels at which the radio transmitter is operated. That is to say, when the radio transmitter is operated at different temperature levels, the characteristics exhibited by the components thereof affect operation of the transmitter. A radio signal intended to be transmitted at a selected frequency might instead be transmitted at a frequency other than that which is intended. Analogously, a radio receiver is also constructed typically of electrical components which exhibit characteristics dependent upon the temperature level. A radio receiver, tuned to a particular frequency to receive a receive signal might, due to temperature variations, be tuned to a frequency other than that which is intended. An intended receive signal might thereby not be detected by the radio receiver.

While changes in temperature might result in misoperation of the radio receiver, thereby preventing adequate reception of radio signals transmitted thereto, such temperature changes resulting in misoperation of a radio transmitter can further result in interference in the proper operation of other radio receiver devices. That is to say, if misoperation of the radio transmitter causes radio signals to be generated upon radio channels other than the intended channel, such radio signals might interfere with signal reception by other radio receivers.

A cellular communication system includes both radio receivers and radio transmitters. A cellular system typically includes a plurality of spaced-apart base stations, each base station formed of a radio transceiver having both radio transmitter circuitry and radio receiver circuitry. A portion of the electromagnetic spectrum is allocated to a cellular communication system to permit the communication of radio-frequency signals between a base station and mobile stations positioned throughout a geographical area encompassed by the network infrastructure of the system. The spectrum allocated to the cellular communication system is efficiently utilized as relatively low-power signals are generated by the mobile stations and network infrastructure so as to permit re-use of the same frequency channels at different locations throughout the area encompassed by the cellular communication system.

The radio transceivers forming the base stations are typically housed within enclosures, herein referred to as cabinets, to shield the circuitry of such radio transceivers from environmental conditions. But, the ambient temperature levels within such cabinets are susceptible to variation as a result of changes in the ambient temperature levels. Such temperature variations make the radio transmitter and receiver circuitry of the base stations susceptible to misoperation for reasons as noted above. While heating elements can be positioned within the cabinets containing the radio transceiver circuitry, such heating elements increase the cost of the base stations as well as require the cabinets to be of increased dimensions.

A manner by which to maintain the temperature levels about the radio transceiver circuitry without utilizing separate heating elements would advantageously reduce the costs associated with the base stations while also permitting the cabinets in which such transceiver circuitry is positioned to be reduced, all the while ensuring that operation of the radio transceiver circuitry not be adversely affected as a result of ambient temperature fluctuation.

It is in light of this background information related to the affects of temperature fluctuations on the operation of electrical devices that the significant improvements of the present invention have evolved.

SUMMARY OF THE INVENTION

The present invention, accordingly, advantageously provides apparatus and an associated method by which to maintain the temperature level of radio circuitry at least as high as a selected temperature level. The temperature level is increased without using separate heating elements positioned about the radio circuitry. Instead thermal energy is generated merely by operating the radio circuitry. The costs associated with the conventional need to utilize separate heating elements is obviated, and containers in which the radio circuitry is housed can be of reduced dimensions as space need not be provided for the separate heating elements.

In one aspect of the present invention, a manner is provided by which to increase ambient temperature levels about base station transceiver circuitry of a radio base station operable in a cellular communication system. The base station transceiver circuitry is housed within a cabinet at a base station site. The transmitter portion of the base station transceiver circuitry includes a power amplifier, such as a Class AB high power amplifier, normally used to amplify up-converted, transmit signals prior to their transmission from the radio base station. Thermal energy is generated as a byproduct of normal operation of the transmitter portion. When radio signals are to be broadcast by the transmitter portion of the transceiver circuitry of the radio base station, thermal energy is generated as a byproduct of operation of the power amplifier. However, during periods of inactivity, i.e., when signals are not broadcast by the radio base station, at a conventional base station, thermal energy is not generated as radio signals are not applied to the power amplifier to be amplified thereat. During operation of an embodiment of the present invention, signals are provided to the power amplifier during periods of otherwise inactivity at the base station. The signals applied to the power amplifier during such periods are selected to be of frequencies beyond the pass bands of filter duplexers to which the amplified signals are provided. Thereby, such signals are not broadcast from the radio base station, but thermal energy generated as a byproduct of amplification of such signals at the power amplifier operates to heat the ambient environment about the transceiver circuitry of the radio base station.

In one implementation, a determination is made as to when the ambient temperature level at the radio base station transceiver circuitry is beneath a selected threshold. When such a determination is made, and radio signals are not being generated to be broadcast from the radio base station, the transmitter portion of the transceiver circuitry is caused to generate signals for application to the power amplifier of the transceiver circuitry. The signals applied to the power amplifier are of frequencies which are beyond the pass band of the transmit filter duplexer. Thereby thermal energy is generated, but signals are not broadcast from the radio base station.

In one implementation, the signals are generated for a selected time period. In another implementation, the signals are generated until the ambient temperature levels reach a second selected threshold temperature level. And, in another implementation, signals are applied to the power amplifier until the ambient temperature levels about the transceiver circuitry are determined to be at least a selected temperature level. In other implementations, operation of an embodiment of the present invention is utilized for increasing the ambient temperature levels about other types of radio devices. Signals are applied to a power amplifier such that, when amplified thereat, heat energy is given off which increases the ambient temperature levels about the radio device.

Thereby, operation of an embodiment of the present invention permits the temperature effects upon radio circuitry due to temperature fluctuations to be overcome. A manner is provided by which to utilize the radio circuitry of a radio device to increase the ambient temperature levels thereabout. The need otherwise to utilize separate heating elements to generate the thermal energy is obviated.

In these and other aspects, therefore, apparatus, and an associated method, is provided for maintaining a base station cabinet temperature at least as a minimum temperature level. A signal generator generates a transmit signal of a selected signal frequency for at least a selected time period. A controller is coupled to the signal generator and selectively generate a control signal to cause the signal generator to generate the transmit signal. An amplifier is coupled to the signal generator to receive the transmit signal generated at the signal generator. The amplifier amplifies the transmit signal and further generates thermal energy as a byproduct of amplification of the transmit signal. A transmit filter is coupled to the amplifier to receive the transmit signal, once amplified by the amplifier. The transmit filter filters the transmit signal, thereby to prevent transmission of the transmit signal.

A more complete appreciation of the present invention and the scope thereof can be obtained from the accompanying drawings which are briefly summarized below, the following detailed description of the presently-preferred embodiments of the invention and the appended claims.

DETAILED DESCRIPTION

Figure 1:
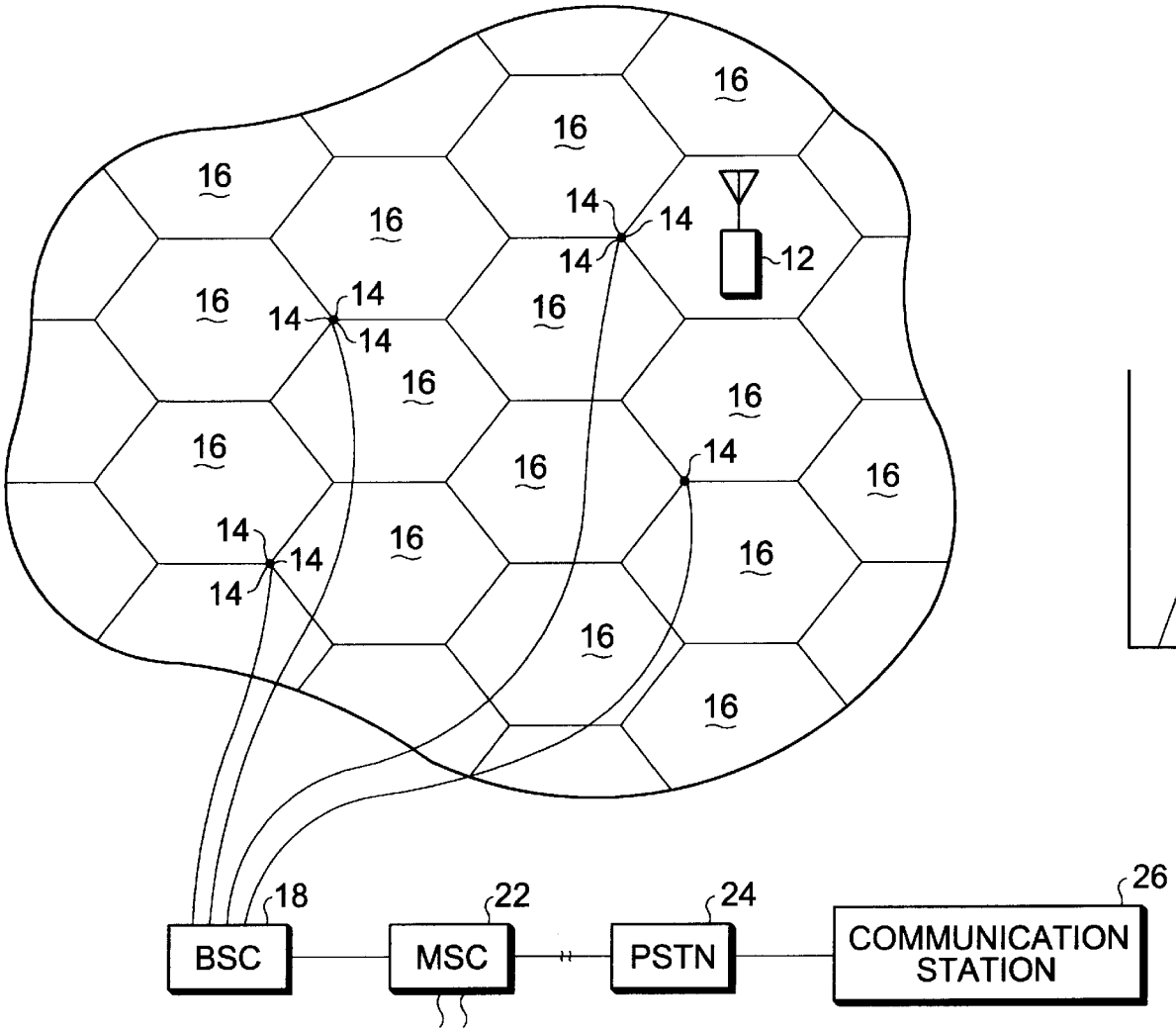
FIG. 1 illustrates a functional representation of a cellular communication system and the positioning of radio base stations of the system and whereat an embodiment of the present invention is operable.

Turning first to FIG. 1, a portion of a cellular communication system, shown generally at 10, provides for wireless communications with mobile stations, of which the mobile station 12 is exemplary. The system 10 includes a plurality of spaced-radio base stations 14 spaced throughout a geographical area. The figure is exemplary in a typical cellular communication system, a large number of radio base stations are positioned throughout. In the implementation shown in the Figure, sets of three radio base stations 14 are co-located. Each base station 14 defines a cell 16 which collectively cover the area encompassed by the cellular communication system. In the exemplary illustration in which sets of three base stations 14 are co-located, each radio base station defines a sector cell in conventional manner. Groups of the radio base stations 14 are coupled to a BSC (base station controller) 18. A BSC is operable to control operation of radio base stations coupled thereto. Groups of BSCs 18, in turn, are coupled to an MSC (mobile switching center). An MSC is operable, amongst other things, to perform switching operations. The MSC is coupled to a PSTN (public-switched telephonic network) 24. And, the PSTN is coupled to communication stations, such as the communication station 26.

The apparatus forming the network infrastructure, its operation, and the operation of the mobile stations 12 operable therein conform with a cellular standard. Signals generated by the radio base stations 14 and also the mobile stations 12 are generated according to the standards pursuant to which the communication system 10 is constructed. For instance, such standards define frequencies and bandwidths upon which signals must be transmitted to prevent interference with other co-generated signals.

Because of the positioning requirements of the radio base stations, the base stations must many times be positioned at locations at which environmental conditions might affect their operation. To prevent misoperation of, or damage to, the circuitry of the radio base stations, such circuitry is typically housed within an enclosure, referred to herein as a cabinet. While a cabinet adequately protects the circuitry of the radio base station from climactic conditions, such enclosures do little to prevent temperature variations from affecting operation of the circuitry of the radio base station. Conventionally, as noted above, separate heating elements are positioned at the radio base station cabinet to generate thermal energy to maintain the circuitry of the radio base stations at least as high as a minimum temperature. However, such separate heating elements increase the cost of the radio base stations and also increase the volumetric dimensions required of the radio base stations. An embodiment of the present invention utilizes the existing circuitry of the transmitter portion of the radio base station circuitry to obviate the need for a separate heater element.

Figure 2:
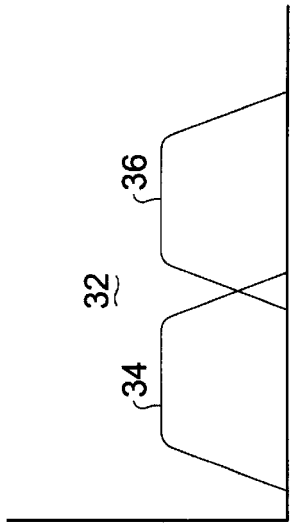
FIG. 2 illustrates the filter response of a conventional filter duplexer forming a portion of an exemplary radio base station of the cellular communication system shown in FIG. 1.

FIG. 2 illustrates a graphical representation, shown generally at 32, of the frequency response of a filter duplexer which forms a conventional radio base station transceiver circuitry. The duplexer includes a receiver filter portion and a transmitter filter portion, each portion having a different frequency pass band. Here, the receive filter portion pass band 34 is shown to have a first pass band, and the transmit filter portion exhibits a second frequency pass band 36. The duplexer filter is coupled to the separate receiver and transmitter portions of the radio transceiver circuitry. Receive signals having signal frequencies within the band 34 of the duplexer are passed therethrough and provided to receiver circuitry of the transceiver. Analogously, signals generated by the transmitter circuitry of the transceiver within the band 36 of the transmitter filter portion of the duplexer are transmitted therefrom. Conversely, signals generated by the transmitter portion of the transceiver which are beyond the pass band 36 of the transmit filter portion of the duplexer are rejected by such filter portion and are not transmitted by the radio transceiver. Advantage of the filter characteristics of the transmitter filter portion of the filter duplexer is made during operation of an embodiment of the present invention.

Figure 3:
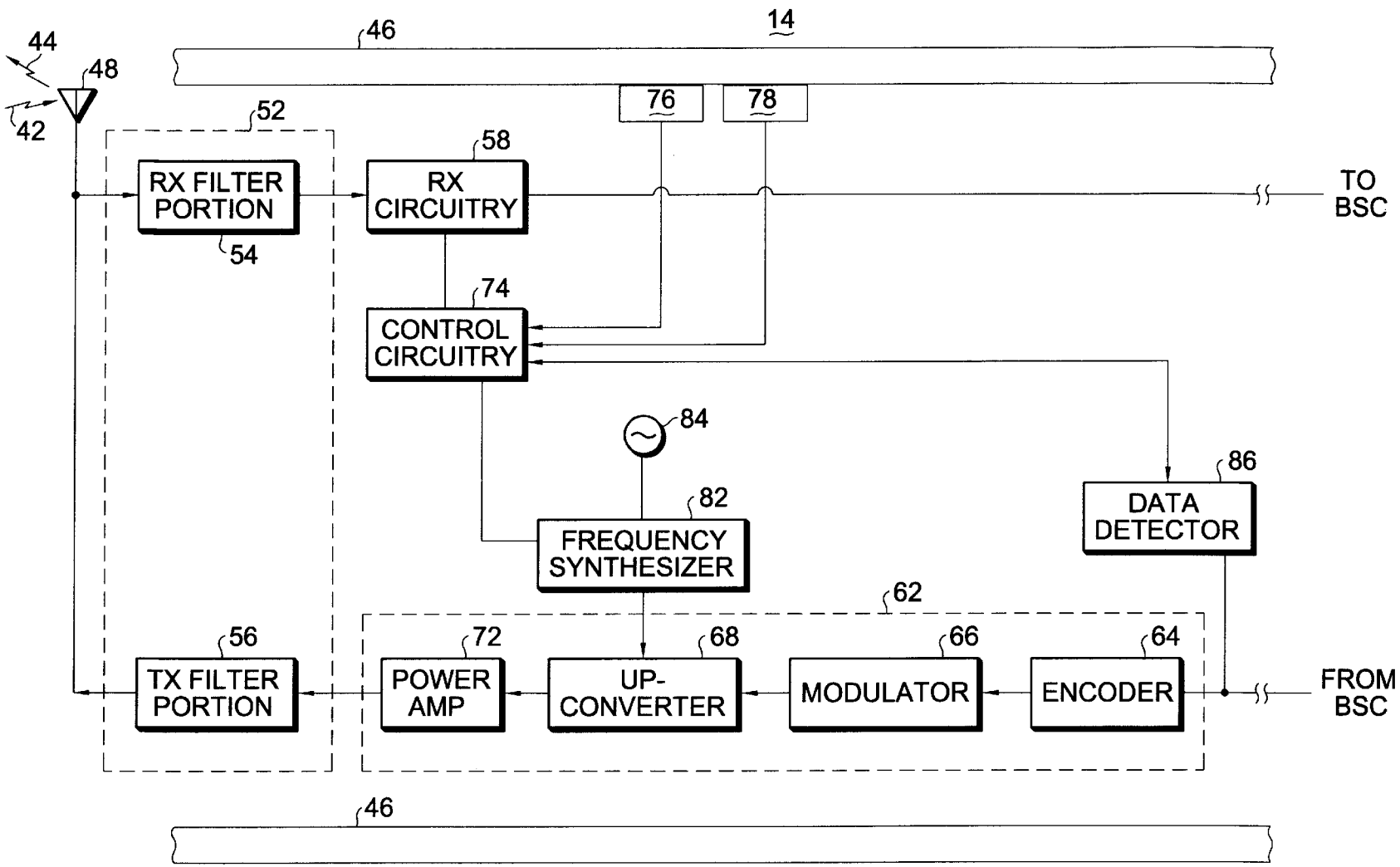
FIG. 3 illustrates a functional block diagram of a radio base station in which an embodiment of the present invention is operable.

FIG. 3 illustrates a functional block diagram of a radio base station 14 in which an embodiment of the present invention is operable. The radio base station 14 is operable to receive reverse link signals 42 transmitted thereto by mobile stations and to transmit forward link signals 44 to such mobile stations. The circuitry of the radio base station 14 is housed within a container, operable to shield the circuitry from climactic conditions. Cabling extends from the circuitry housed within the container 46 to a mast head 48. The mast head 48 forms an antenna transducer for transducing into, and out of electromagnetic form, the forward and reverse-link signals 44 and 42, respectively.

The cable extending between the mast head 48 and the circuitry of the radio base station extends to the filter duplexer 52 which exhibits the frequency response shown by the graphical representation 32 of FIG. 2. The filter portions 54 and transmitter portions 56 of the filter duplexer 52 are separately represented in the Figure. The receive filter portion 54 is coupled to receiver circuitry 58 of the radio base station circuitry. Such receiver circuitry 58 is, in turn, coupled to other elements of the network infrastructure of the communication system 10 (shown in FIG. 1).

The transmit filter portion 56 is coupled to transmitter portion 62 of the radio base station circuitry. The transmitter portion 62 is coupled to other portions of the communication system 10 (shown in FIG. 1).

The transmitter portion is shown to include an encoder element 64, operable to encode signals provided thereto from other portions of the communication system. Once encoded, encoded signals are provided to a modulator element 66. The modulator element modulates the encoded signal according to a modulation scheme. Once modulated, modulated signals are provided to an up-converter element 68. The up-converter element is formed of one or more up-conversion stages for up-converting the modulated signal to a radio frequency.

Once up-converted, the radio frequency signals are provided to a power amplifier 72, here a Class AB amplifier. The power amplifier is operable to amplify the signals provided thereto to be of energy levels to permit air transmission from the radio base station 14. Amplified signals are filtered by the transmitter filter portion 56 of the duplexer filter 52, and thereafter transduced by the mast head antenna 48. Operation of an embodiment of the present invention advantageously takes advantage of a byproduct of operation of the power amplifier that is, generation of thermal energy during generation of signals by the power amplifier.

Because of the thermal energy generated as a byproduct of operation of the power amplifier, such thermal energy is used to maintain the thermal energy levels of the radio base station circuitry of the radio base station 14 at a temperature at least as high as a selected threshold. While, during normal operation of the radio base station to transmit forward-link signals 44, the power amplifier 72 generated thermal energy as a byproduct of its normal operation, during low levels of usage of the radio base station 14, the power amplifier is normally not used to amplify signals, and byproduct, thermal energy is not generated.

The radio base station 14 of an embodiment of the present invention further includes control circuitry, here shown to be coupled both to the receiver circuitry 58 and to the transmitter circuitry 62 to control operation of the respective portions of the radio base station. In addition to control functions normally associated with the control circuitry, the control circuitry 74 is further operable here to maintain the ambient temperature levels within the container 46 to be of at least a minimum threshold temperature.

Here, the control circuitry 74 is coupled to a first thermocouple 76 and a second thermocouple 78 having first and second set-points, respectively. The control circuitry is further coupled to a frequency synthesizer 82. The frequency synthesizer, in turn, is coupled to receive an oscillating signal, here represented to be generated by an oscillator 84. And, the control circuitry is further shown to be coupled to a data detector 86.

The data detector 86 is operable to determiner when data is provided to the radio base station 14 to be transmitted therefrom. When the data detector 86 determines there not to be significant levels of data provided to the base station to be transmitted therefrom, an indication of such determination is provided to the control circuitry. The control circuitry is operable, here, amongst other things, responsive to such determination by the data detector and also an indication by the first thermocouple 76 that the ambient temperature levels are beneath the first threshold, the control circuitry causes the frequency synthesizer 82 to provide oscillating signals of a selected frequency to the up-converter so that the up-converter generates up-converted signals to be amplified by the power amplifier 72.

The signals caused to be applied to the up-converter are selected such that the resultant, up-converted signals applied to the amplifier 72 are beyond the pass band 36 of the transmitter filter portion 56 of the duplexer 52. Thereby, heat is generated as a byproduct of operation of the power amplifier to increase the ambient temperature levels within the cabinet 64 of the radio base station but to prevent the transmission of amplified signals which might cause interference with operation of the communication system.

In one implementation, the up-converted signals are caused to be generated for a selected period of time. In another implementation, the up-converted signals are caused to be generated until the set point of the second thermocouple 78 indicates that the ambient temperature levels have reached a selected threshold. And, in the event that the data detector 86 determines there to be data to be transmitted by the radio base station, the up-converter 68 is no longer provided with the signal generated by the frequency synthesizer; instead, the radio base station is caused to be operated conventionally.

Figure 4:
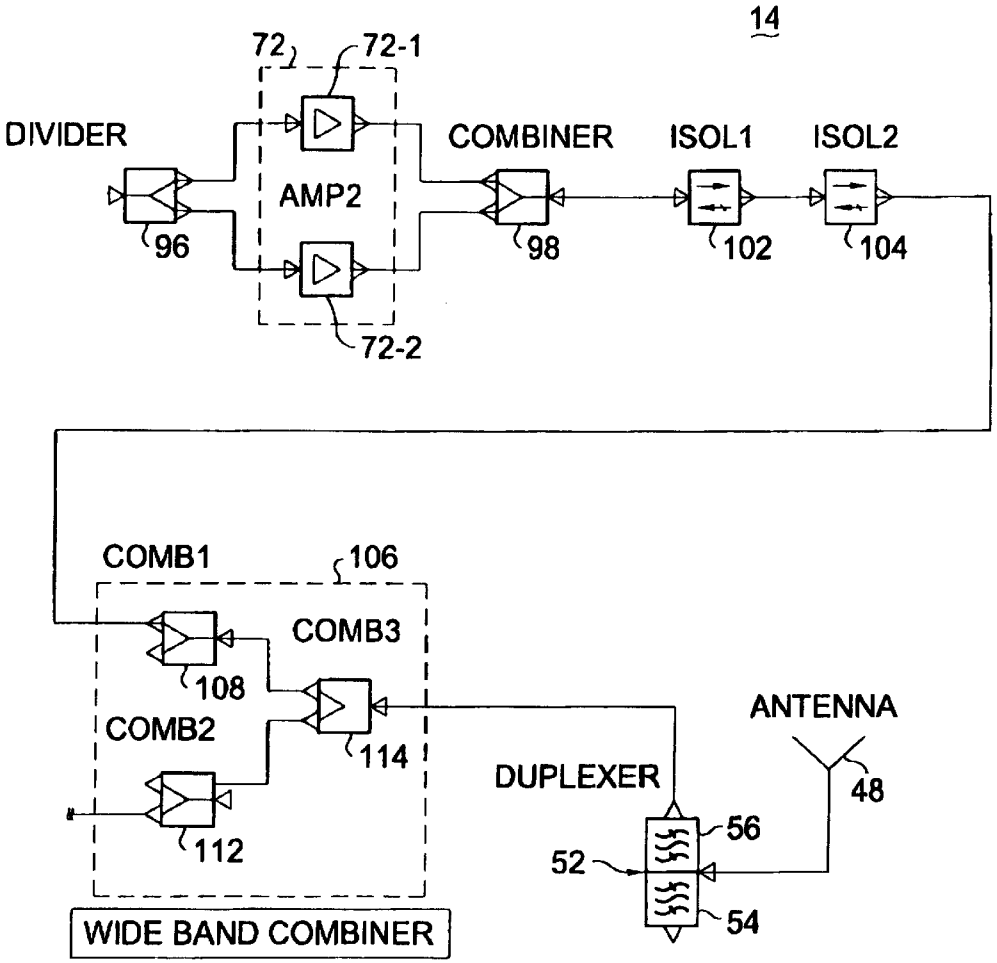
FIG. 4 illustrates a functional block diagram of a portion of the base station shown in FIG. 3 according to a specific implementation of the present invention.

FIG. 4 illustrates a portion of the radio base station 14 shown in FIG. 3 of an embodiment of the present invention. Again, a mast head antenna 48, filter duplexer 52, including portions 54 and 56, and a power amplifier 72, here shown to be formed of a first portion 72-1 and a second portion 72-2, are again shown to form portions of the radio base station. The implementation here is shown further to include a divider element 96, a combiner 98, isolators 102 and 104 and a wide band combiner 106, here formed of combiner elements 108, 112, and 1 14.

Again operation of an embodiment of the present invention makes it possible to warm up the ambient temperature levels within the cabinet of the radio base station without the need for utilization of separate heater elements. By maintaining the ambient temperature levels within a selected range, base station operation, guaranteed only within a limited temperature range, is assured.

In the exemplary implementation, the signal caused to be generated by the up-converter 68 (shown in FIG. 3) and provided to the amplifier 72 is of a frequency value between the pass bands 34 and 36 of the filter duplexer. The output frequency for the base station signal is set by the frequency synthesizer 82 (shown in FIG. 3). For instance, when the radio base station is operable in a GSM (global system for mobile communications) system, the synthesizer is set, for example, to be approximately 10 megahertz beyond the transmit band. If the expanded operation range requirement is taken into account in the specification phase, the frequency synthesizer 82 can be designed to tune to certain transmit frequencies that have also been specified for the duplexer filter. For instance, frequency synthesizers, such as the frequency synthesizer 82, is designed to exhibit a wider tuning bandwidth than its operational range due to susceptibility of frequency overshoot when jumping, i.e., tuning to an edge channel. Usually frequency synthesizers need to have as wide a tuning bandwidth as the operational range because of possible overshooting when jumping to the edge channel.

When the signal generated by the power amplifier 72 is outside of the pass band 36, the signal is reflected from the filter 52. Attenuation of such signal can be up to −90 dB. The actual level of attenuation is dependent on how far away the synthesizer 82 can be tuned and how the filters are specified.

The amplified signal generated by the amplifier 72 is reflected back from the transmitter filter portion 56 of the filter duplexer with low loss. In the implementation shown in FIG. 4, prior to application to the duplexer, the signal is attenuated at the combiner 106, here a four-way combiner, by about 6.5 dB.

A signal reflected back by the duplexer 52 propagates backwards and again experiences another 6.5 dB loss, and thereafter returns to the power amplifier 72 output lines. Typically, at the power amplifier output lines, the isolators 102 and 104 each provide about 20 dB of isolation, totaling about 40 dB attenuation of the backwards-propagating signal. Power reflected from the duplexer is thereby dissipated by the combiner 106 and isolators 102 and 104.

Such circuitry is typical of radio base stations as low internal IM levels at the transmitter output generated by two or more closely spaced, transmitted signals. Power amplifiers are also designed typically to resist short or open load in the output with certain relatively high power levels and without automatic power reduction features with high reflection co-efficiency.

Figure 5:
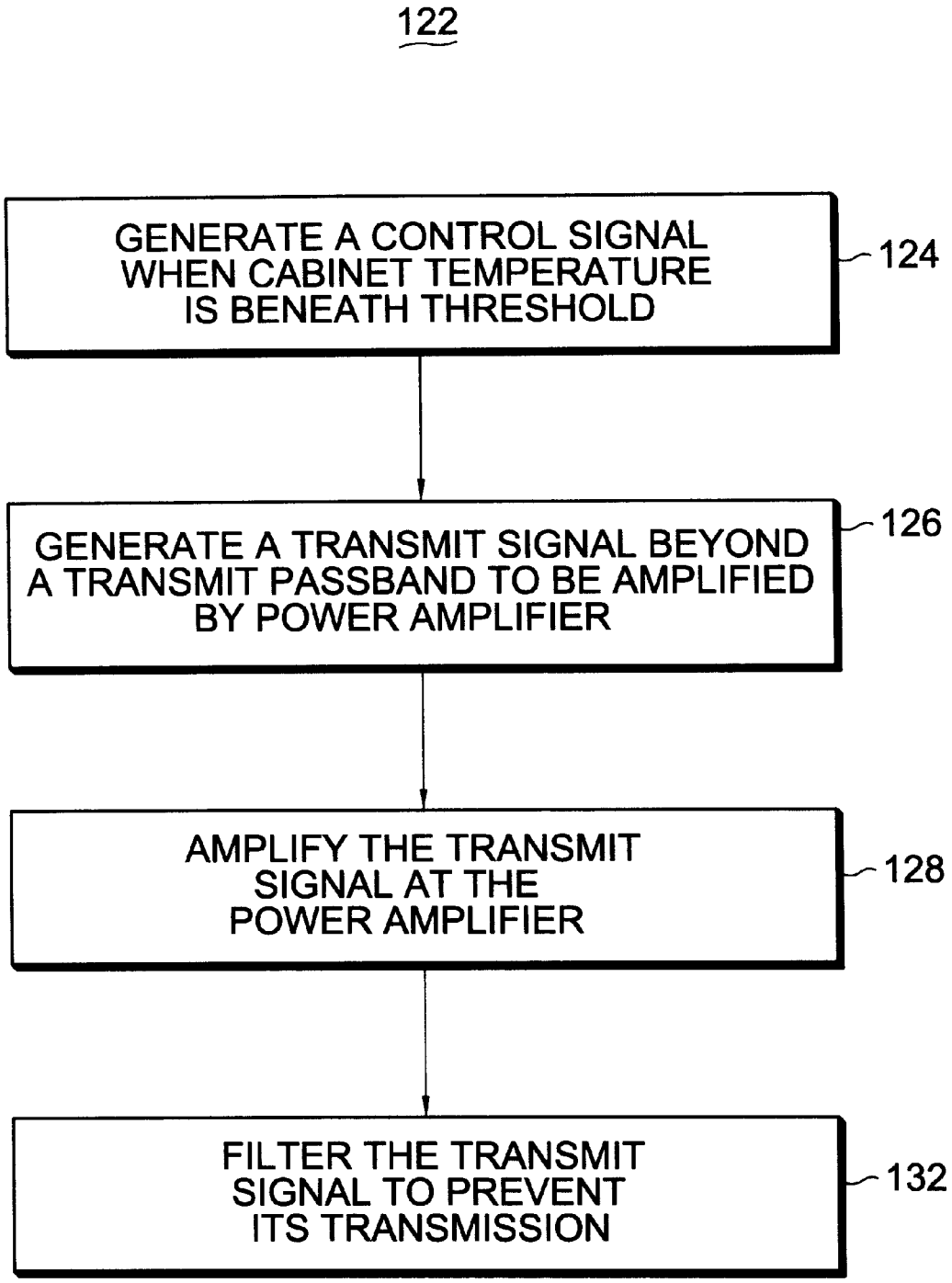
FIG. 5 illustrates a method flow diagram listing the method steps of the method of operation of an embodiment of the present invention.

FIG. 5 illustrates a method, shown generally at 122, of an embodiment of the present invention. The method is for maintaining a base station cabinet which houses a base station transmitter at least at a minimum temperature level.

First, and as indicated by the block 124, a control signal is selectively generated at least responsive to when the base station cabinet temperature is beneath a minimum temperature level. Then, and as indicated by the block 126, a transmit signal is generated at a signal generation portion of the base station transmitter. The transmit signal is generated for at least a selected time period.

Then, and as indicated by the block 128, the transmit signal is amplified at an amplifier portion of the base station transmitter. The amplifier portion further generates thermal energy as a byproduct of amplification of the transmit signal. The thermal energy heats the base station cabinet to at least the minimum temperature level. And, as indicated by the block 132, the transmit signal is filtered to prevent its transmission from the base station transmitter.

The previous descriptions are of preferred examples for implementing the invention, and the scope of the invention should not necessarily be limited by this description. The scope of the present invention is defined by the following claims.

What is claimed is:

1. Apparatus for manufacturing a base station cabinet temperature at least at a minimum temperature level, said apparatus comprising:

a signal generator for generating a transmit signal of a selected signal frequency, for at least a selected time period;

a controller coupled to said signal generator, said controller for selectively generating a control signal to cause said signal generator to generate the transmit signal;

an amplifier coupled to said signal generator to receive the transmit signal generated at said signal generator, said amplifier for amplifying the transmit signal, said amplifier further generating thermal energy as a by product of amplification of the transmit signal; and a transmit filter coupled to said amplifier to receive the transmit signal, once amplified by said amplifier, said transmit filter for filtering the transmit signal, thereby to prevent transmission thereof.

2. The apparatus of claim 1 wherein said signal generator comprises up-converter elements of base-station radio transmitter circuitry.

3. The apparatus of claim 1 wherein the selected signal frequency is of a frequency level beyond a pass band of said transmit filter.

4. The apparatus of claim 1 wherein said controller generates the control signal when the base station cabinet temperature is beneath a first threshold and wherein the selected time period during which said signal generator generates the transmit signal comprises a time period during which the base station cabinet temperature remains beneath the first threshold.

5. The apparatus of claim 1 wherein said controller generates the control signal when the base station cabinet temperature is beneath a first threshold and continues to generate the control signal until the base station cabinet temperature reaches a second threshold.

6. The apparatus of claim 1 wherein said controller generates the control signal when the base station cabinet temperature falls below a first threshold, and wherein the selected time period is timed starting when the base station cabinet temperature falls beneath the first threshold.

7. The apparatus of claim 1 further comprising a temperature determiner coupled to said controller, said temperature determiner for determining at least when the base station cabinet temperature is of a first selected threshold.

8. The apparatus of claim 7 wherein the temperature determiner further determines when the base station cabinet temperature is of a second selected threshold.

9. The apparatus of claim 1 wherein said amplifier comprises a Class AB power amplifier of base-station radio transmitter circuitry.

10. The apparatus of claim 1 wherein said transmit filter comprises a transmit portion of a duplex filter of base-station radio transmitter circuitry.

11. In a radio device positioned at a cabinet at least partially to enclose the radio device, an improvement of apparatus for at least selectively increasing a temperature level at the cabinet, said apparatus comprising:

a controller operable at least when the temperature level at the cabinet is below a first threshold, said controller for generating a control signal to cause the radio device to generate an amplified signal of a selected frequency, the selected frequency beyond a pass band of a transmit filter of the radio device, thereby to prevent transmission of the amplified signal, thermal energy generated as a byproduct of formation of the amplified signal for increasing the temperature levels at the cabinet.

12. The apparatus of claim 11 further comprising a temperature determiner coupled to said controller, said temperature determiner for determining at least when the temperature levels at the cabinet are beneath the first threshold and for providing indications of determinations thereat to said controller.

13. The apparatus of claim 11 wherein said controller is further for generating the control signal to cause the radio device to cease generation of the amplified signal of the selected frequency when the temperature levels at the cabinet reach a second threshold.

14. The apparatus of claim 13 further comprising a temperature determiner coupled to said controller, said temperature determiner for determining at least when the temperature levels at the cabinet are beneath the first threshold and when the temperature levels at the cabinet are at least at the second threshold, and for providing indications of determinations made thereat to said controller.

15. The apparatus of claim 11 wherein the radio device is operable to transmit radio signals within the pass band of the transmit filter and wherein said controller generates the control signal when both the radio device is not being operated to transmit the radio signals and the temperature level at the cabinet is below the first threshold.

16. A method for maintaining a base station cabinet which houses a base station transmitter at least at a minimum temperature level, the said method comprising:

selectively generating a control signal at least responsive to when the base station cabinet temperature is beneath the minimum temperature level;

generating, responsive to the control signal, a transmit signal at a signal generation portion of the base station transmitter, the transmit signal generated for at least a selected time period;

amplifying the transmit signal at an amplifier portion of the base station transmitter, the amplifier portion further generating thermal energy as a byproduct of amplification of the transmit signal, the thermal energy for heating the base station cabinet to at least the minimum temperature level; and filtering the transmit signal, amplified during said operation of amplifying at a transmit filter portion of the base station transmitter, the transmit filter portion exhibiting a filter pattern for rejecting the transmit signal.

17. The method of claim 16 comprising the additional operation, prior to said operation of selectively generating the control signal, of determining a temperature level of the base station cabinet.

18. The method of claim 16 wherein the base station transmitter is selectively operable to transmit radio signals within the pass band of the transmit filter portion and wherein the control signal is generated only when both the base station transmitter is not being operated to transmit radio signals and the base station cabinet temperature is beneath the minimum temperature level.

19. The method of claim 18 wherein the transmit signal is generated until either the base station cabinet temperature level is at least the minimum temperature level or the radio signal is generated.

20. The method of claim 16 wherein said operation of amplifying is performed at a Class AB amplifier.

* * * * *